US011420449B2

(12) United States Patent
Breintner

(10) Patent No.: US 11,420,449 B2
(45) Date of Patent: Aug. 23, 2022

(54) DRYING UNIT AND METHOD FOR DRYING A SUBSTRATE

(71) Applicant: Canon Production Printing Holding B.V., Venlo (NL)

(72) Inventor: Tobias Breintner, Lengdorf (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/953,770

(22) Filed: Nov. 20, 2020

(65) Prior Publication Data

US 2021/0155013 A1 May 27, 2021

(30) Foreign Application Priority Data

Nov. 26, 2019 (DE) ..... 102019131984.6

(51) Int. Cl.
*B41J 11/00* (2006.01)

(52) U.S. Cl.
CPC ..... *B41J 11/002* (2013.01); *B41J 2203/00* (2020.08)

(58) Field of Classification Search
CPC .. B41J 11/002; B41J 2203/00; B41J 11/0022; B41J 11/00216
See application file for complete search history.

(56) References Cited

U.S. PATENT DOCUMENTS

2009/0295894 A1* 12/2009 Hori ..... B41J 2/155 347/102
2014/0253624 A1* 9/2014 Boland ..... B41J 11/00222 347/17
2014/0366760 A1* 12/2014 Boland ..... B41J 11/00216 101/424.1

OTHER PUBLICATIONS

German action dated Aug. 4, 2020, Application No. 10 2019 131 984.6.

* cited by examiner

*Primary Examiner* — Bradley W Thies
(74) *Attorney, Agent, or Firm* — The Webb Law Firm

(57) ABSTRACT

A dryer comprises at least one dryer that is configured to supply thermal energy to a substrate in order to dry said substrate via evaporation of fluid. Information with regard to the degree of drying of the substrate may be precisely determined via comparison of a measurement value of the temperature of the substrate with the equilibrium temperature that results given an equilibrium of latent heat and supplied thermal energy. Alternatively or additionally, the degree of drying of the substrate may be precisely set.

15 Claims, 4 Drawing Sheets

DRYING UNIT AND METHOD FOR DRYING A SUBSTRATE

CROSS REFERENCE TO RELATED APPLICATIONS

This patent application claims priority to German Patent Application No. 102019131984.6, filed Nov. 26, 2019, which is incorporated herein by reference in its entirety.

BACKGROUND

Field

The disclosure relates to the fixing of a print image printed by a printing device, in particular by an inkjet printing device, onto a substrate or onto a recording medium. In particular, the disclosure relates to the determination of the degree of drying of a recording medium, and/or to the adaptation of one or more drying parameters of a dryer for the adjustment of the degree of drying of a recording medium.

Related Art

A printing device, in particular an inkjet printing device, for printing to a recording medium may comprise one or more print heads respectively having one or more nozzles. The nozzles are respectively configured to eject ink droplets in order to print dots of a print image onto the recording medium. The one or more print heads and the recording medium are thereby moved relative to one another in order to ink dots onto the recording medium at different positions, in particular in different lines, and in order to thus print a print image onto the recording medium. The print image is typically dried and/or fixed in a drying unit.

The quality of a print image typically depends on the degree of drying of the dried and/or fixed print image. Furthermore, the quality of a subsequent process step, for example film formation and/or the coating of the print image, typically depends on the degree of drying of the print image.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
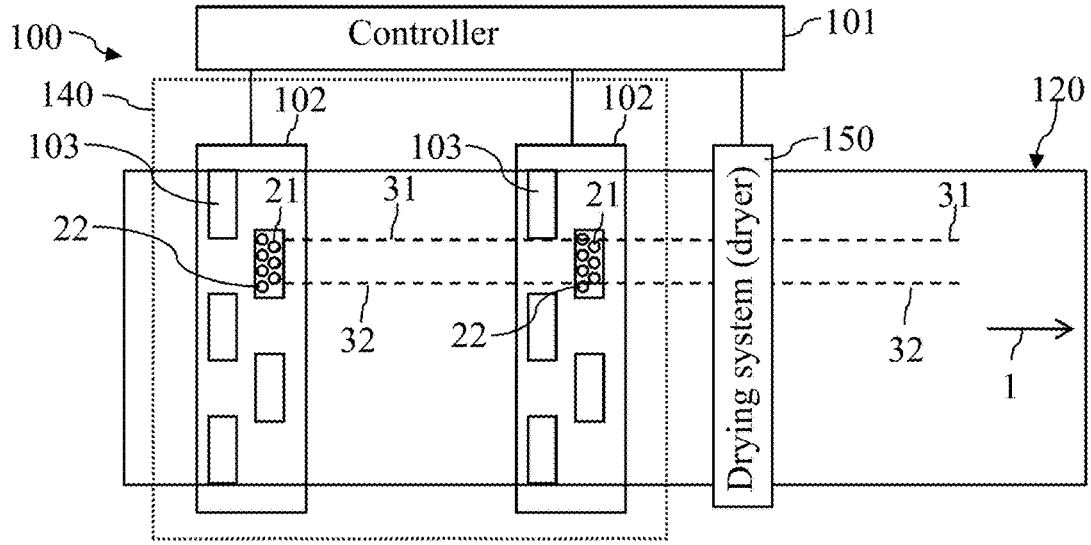

FIG. 1*a* is a block diagram of an example of an inkjet printing device.

Figure 1B:
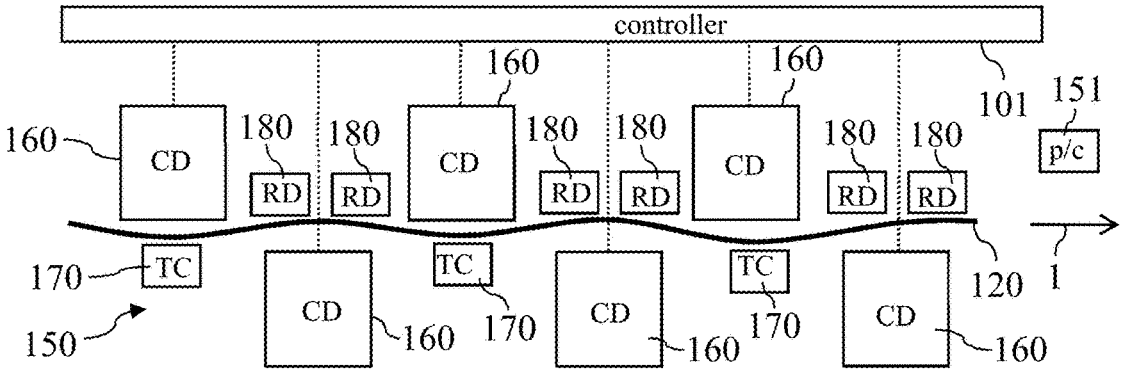

FIG. 1*b* is a block diagram of an example of a drying or fixing system, according to an exemplary embodiment, for an inkjet printing device.

Figure 1C:
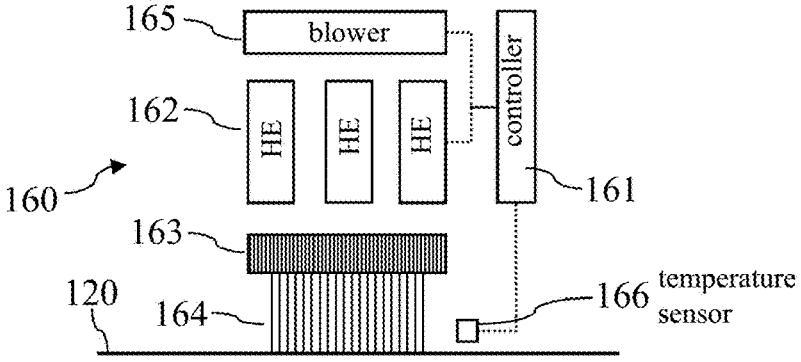

FIG. 1*c* is a block diagram of a convection dryer, according to an exemplary embodiment, for a drying or fixing system.

Figure 1D:
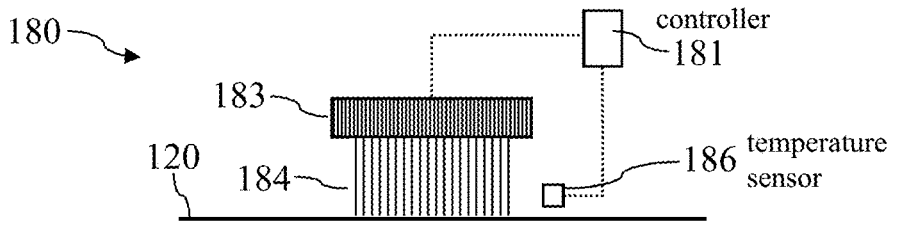

FIG. 1*d* is a block diagram of a radiant dryer, according to an exemplary embodiment, for a drying or fixing system.

Figure 2A:
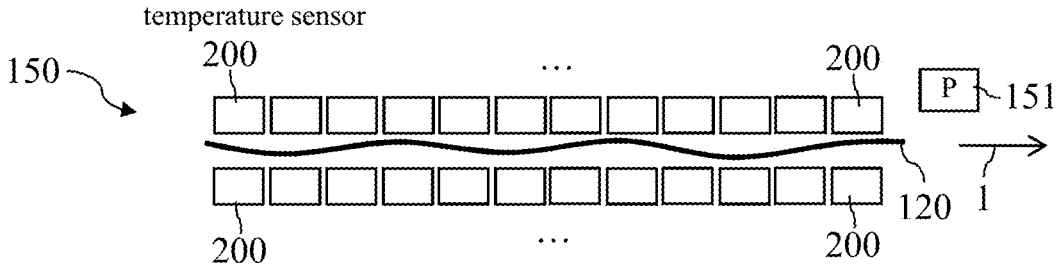

FIG. 2*a* is a drying system according to an exemplary embodiment having at least one temperature sensor, in particular having a row of temperature sensors, for measurement of a temperature curve of the recording medium along the drying route.

Figure 2B:
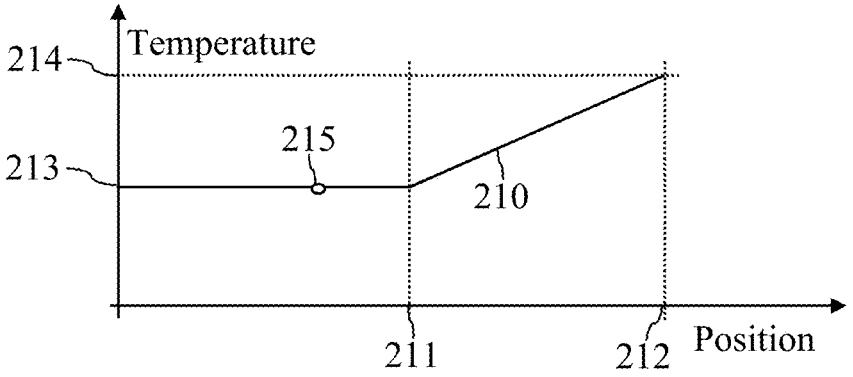

FIG. 2*b* illustrates a temperature curve according to an exemplary embodiment.

Figure 3A:
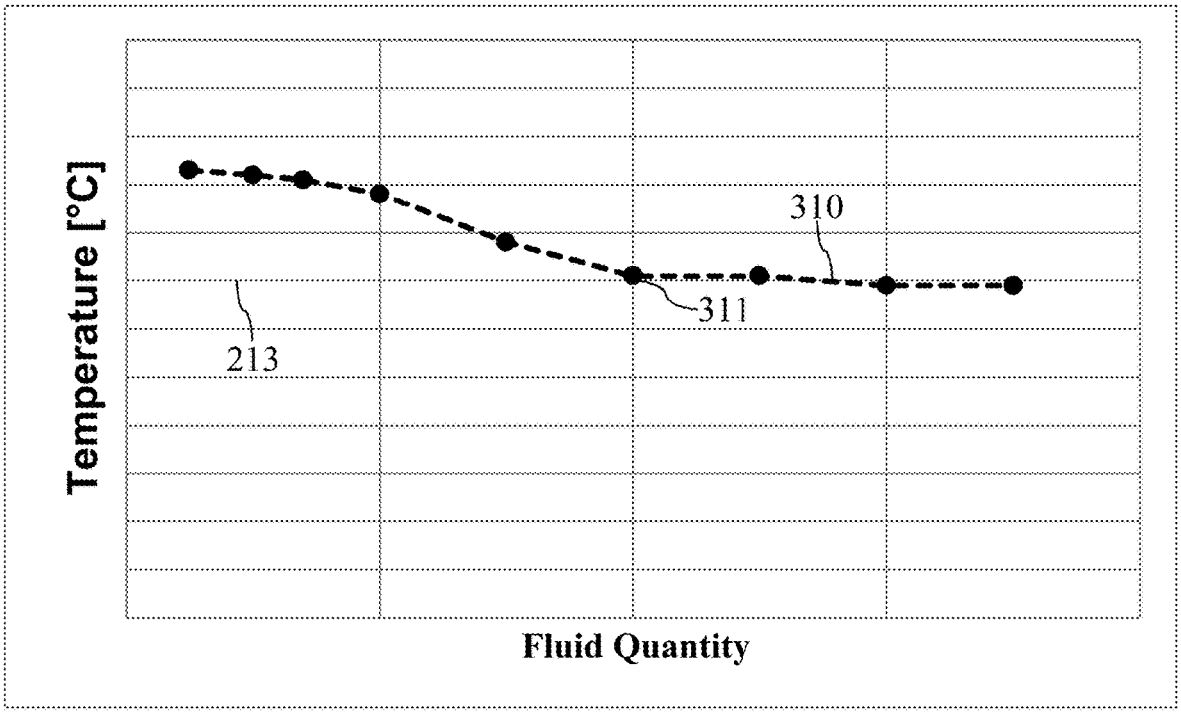

FIG. 3*a* illustrates a correlation between the temperature of a recording medium following the drying and the original quantity of fluid on the recording medium according to an exemplary embodiment.

Figure 3B:
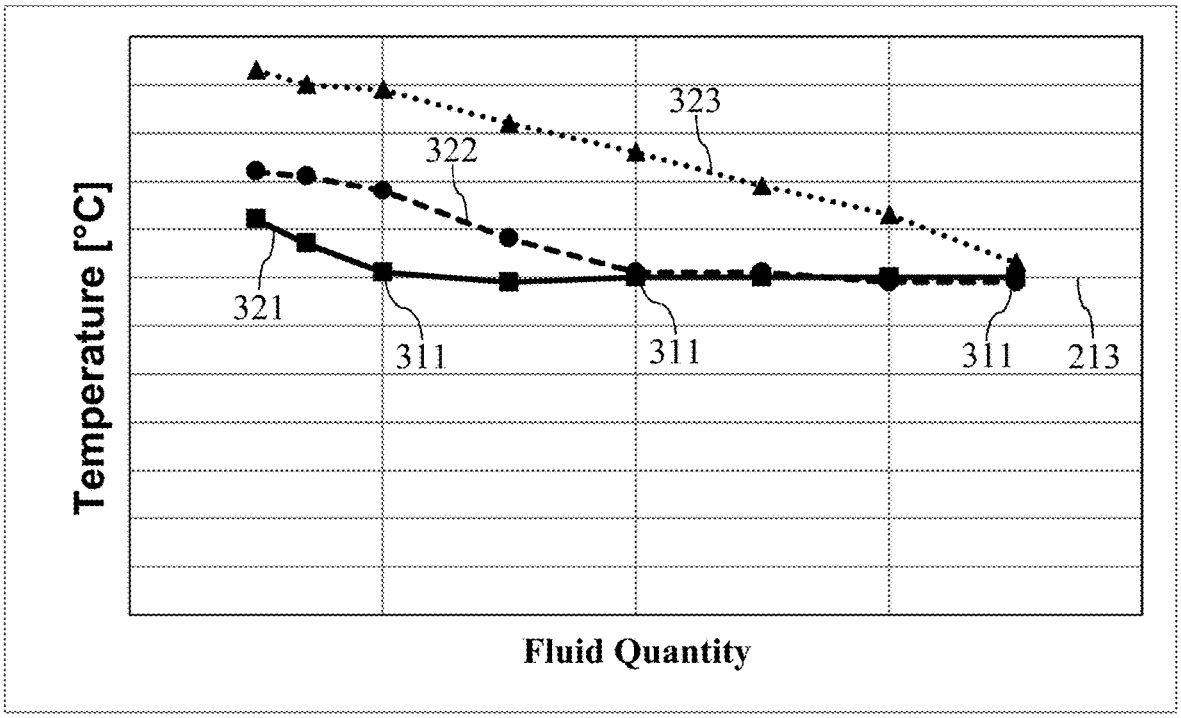

FIG. 3*b* illustrates temperature/fluid quantity correlations for different drying capacities according to an exemplary embodiment.

Figure 4:
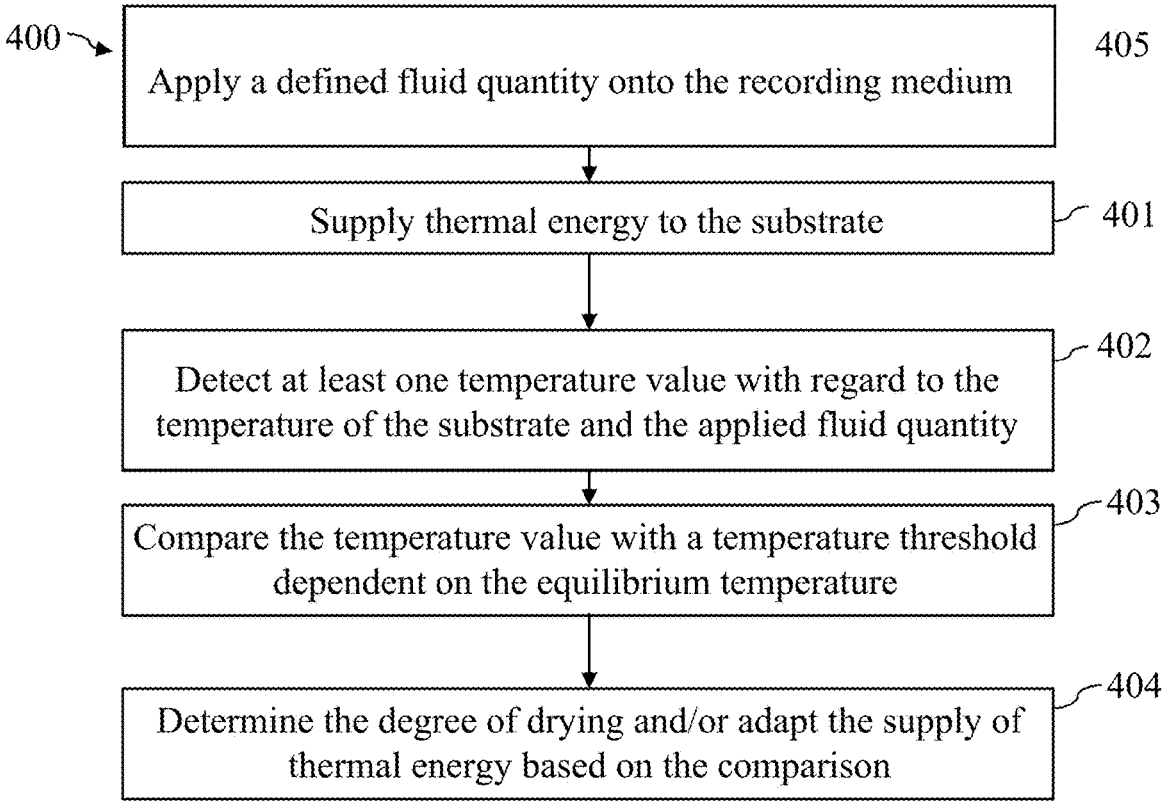

FIG. 4 is a flowchart of a method for drying a recording medium according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to precisely and efficiently determine and/or adjust the degree of drying of a substrate, in particular the degree of drying of a print image on a substrate.

According to one aspect of the disclosure, a drying system is described for drying a substrate, in particular a recording medium. The drying system comprises at least one dryer that is configured to supply thermal energy to the substrate in order to dry the substrate via evaporation of fluid. Furthermore, the drying system comprises at least one temperature sensor that is configured to detect at least one temperature value in relation to the temperature of the substrate.

The drying system also comprises a processor that is configured to compare the temperature value with a temperature threshold, wherein the temperature threshold depends on an equilibrium temperature that results given an equilibrium of latent heat and supplied thermal energy at the substrate. Furthermore, depending on the comparison the processor is configured to determine information regarding the degree of drying and/or to operate the dryer depending on the comparison.

According to a further aspect, a computer-implemented method is described for drying a substrate. The method includes supplying thermal energy to the substrate in order to dry the substrate via evaporation of fluid. Furthermore, the method includes the detection of at last one temperature value of the temperature of the substrate during the drying. The method also includes the comparison of the temperature value with a temperature threshold, wherein the temperature threshold depends on an equilibrium temperature of the substrate that results given an equilibrium of latent heat and supplied thermal energy. Moreover, the method includes the determination of information with regard to the degree of drying of the substrate depending on the comparison and/or the adaptation of the supply of thermal energy, in particular the adaptation of the thermal capacity and/or the type of thermal energy, depending on the comparison.

The printing device 100 depicted in FIG. 1*a* is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed through the print head 140 of the printing device 100 along the transport direction 1, which is represented by an arrow.

In the depicted example, the print group 140 of the printing device 100 comprises two print bars 102, wherein each print bar 102 may be used for printing with ink of a defined color, for example black, cyan, magenta, and/or yellow, and if applicable MICR ink. Different print bars 102 may be used for printing with respective different inks. Furthermore, the printing device 100 comprises at least one fixing or drying system 150 that is configured to fix and/or to dry a print image printed onto the recording medium 120. The fixing or drying system 150 can be referred to as a fixer or dryer in aspects of the disclosure.

A print bar 102 may comprise one or more print heads 103 that are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120. The number of print heads 103 of a print bar 102 may be 5 or more or 10 or more, for example.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 103 of the print group 140 may comprise multiple thousands of effectively utilized nozzles 21, 22, for example, that are arranged along a plurality of rows transverse to the transport direction 1. Dots of a line of a print image may be printed onto the recording medium 120 transverse to the transport direction 1, i.e. along the width of the recording medium 120, by means of the nozzles 21, 22 of a print head 103 of the print group 140.

The printing device 100 also comprises a controller 101, for example a control hardware and/or a controller, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101. The controller 101 can include a memory that stores executable instructions and/or other data, and a processor. The processor is configured to execute the instructions to perform the functions and/or operations of the controller 101. The controller 101 may be additionally or alternatively configured to access an external memory storing instructions (or otherwise receive instructions from an external source), where these instructions are then executed by the controller 101 to perform the functions/operations of the controller 101.

The print group 140 of the printing device 100 thus comprises at least one print bar 102 having K nozzles 21, 22, wherein the nozzles 21, 22 may be arranged in one or more print heads 103, and wherein the nozzles 21, 22 may be activated with a defined line timing or with a defined activation frequency in order to print a line traveling transverse to the transport direction 1 of the recording medium 120 onto the recording medium 120 with K pixels or K columns 31, 32 of a print image, for example with K>1000. In the depicted example, the nozzles 21, 22 are installed immobile or fixed in the printing device 100, and the recording medium 120 is directed past the stationary nozzles 21, 22 with a defined transport velocity. What fluid/ink quantity has been applied onto the recording medium is known due to the control of the nozzles.

As depicted above, the printing device 100 may comprise a drying or fixing system 150 that is configured to dry the recording medium 10 after application of the ink via the one or more print bars 102, and therefore to fix the applied print image onto the recording medium 120. For this purpose, the drying or fixing system 150 may be controlled by a controller 101 of the printing device 100. For example, the drying or fixing may take place depending on the quantity of applied ink and/or depending on a type of the recording medium 120, in particular depending on absorption properties of the recording medium 120 that is used.

The drying or fixing system 150 that is depicted in FIG. 1*b* comprises a plurality of dryers or fixers 160, 170, 180 that are arranged on both sides of a recording medium 120, for example in the form of a web, along a drying or fixing route. In particular, the drying or fixing system 150 may comprise one or more convection dryers 160 that are respectively configured to blow a gaseous drying medium, typically heated air, onto the surface of the recording medium 120. The print image on the recording medium 120 may thus be gently and reliably dried along the drying route of the drying or fixing system 150. If applicable, the drying energy and/or the drying capacity of the individual dryers 160 may thereby be individually adjusted.

FIG. 1*c* shows a block diagram having examples of components of a convection dryer 160. The convection dryer 160 depicted in FIG. 1*c* comprises a blower 165 with which the gaseous drying medium 164 may be directed past one or more heating elements 162. The drying medium 164 heated by the heating elements 162 is then blown onto the surface of the recording medium 120 via one or more openings or nozzles 163. The discharge rate of the blower 165 and/or the heating capacity of the one or more heating elements 162 may be controlled or regulated and/or individually adjusted via a controller 161, wherein the controller 161 may, if applicable, be part of the controller 101 of the drying or fixing system 150 or of the printing device 100. In particular, the temperature in the environment of the recording medium 120 may be detected by means of a temperature sensor 166. The controller 161 may be configured to control or regulate the blower 165 and/or the one or more heating elements 162 depending on sensor data of the temperature sensor 166. For example, a defined temperature in the environment of the recording medium 120 may thus be set. In an exemplary embodiment, the controller 161 includes processor circuitry that is configured to perform one or more functions and/or operations of the controller 161.

The drying or fixing system 150 depicted in FIG. 1*b* also comprises one or more radiant dryers 180 that are configured to expose the print image to be fixed with radiation, for example with infrared radiation. The exposure leads to a heating of the ink and of the recording medium 120.

FIG. 1*d* shows an example of a radiant dryer 180 having a radiation source 183 that is configured to generate radiation 184 (for example infrared (IR) radiation) to expose the recording medium 120. For example, the radiation source 183 may comprise one or more light-emitting diodes (LEDs), in particular LEDs for IR radiation. The dryer 180 may comprise a temperature sensor 186. Furthermore, the dryer 180 may comprise a controller 181 that is configured to operate the radiation source 183 depending on the sensor data of the temperature sensor 186. For example, the intensity and/or the spatial distribution and/or the spectrum of the radiation 184 may be varied as a fixing parameter.

Furthermore, the drying or fixing system 150 depicted in FIG. 1*b* comprises one or more thermal conduction dryers 170 that are configured to warm the recording medium 120 from the (unprinted) back side. A thermal conduction dryer 170 comprises a warmed heating surface or a heating saddle across which the back side of the recording medium 120 is directed in order to warm the recording medium 120. A thermal conduction dryer 170 has an evaporation rate for water that is relatively low in comparison to the evaporation rate given a convection dryer 160.

A drying or fixing system 150 may thus be provided that comprises one or more types of dryers 160, 170, 180, possibly with different evaporation rates for the water in the ink applied onto a recording medium 120. Via the use of different types of dryers 160, 170, 180, and/or via the adaptation or adjustment of one or more drying parameters of the individual dryers 160, 170, 180, the drying or fixing process of an ink-based print image may be adjusted such that the dried print image exhibits a defined nominal degree of drying as of a defined point in time during the drying, or at the output of the drying system 150 or at the end of the drying route. A qualitatively high-grade print image and/or a reliable post-processing of the print image may thus be enabled.

FIG. 3*a* shows an example of a correlation 310 of the temperature of a dried recording medium 120 at the output of a drying system 150 with the original fluid quantity, in particular ink quantity, applied onto the recording medium 120. From the temperature/fluid quantity correlation 310, it is to be learned that the temperature of the dried recording medium 120 decreases with increasing fluid quantity until a fluid quantity limit 311 is reached. For fluid quantities as of the fluid quantity limit 311 and higher, the temperature of the recording medium 120 at the output of the drying system 150 remains essentially constant at an equilibrium temperature 213.

The effect depicted in FIG. 3*a* is to be ascribed to the fact that, at the recording medium 120, an equilibrium results between latent heat on the one hand and the thermal energy applied to the recording medium 120 within the drying system 150 on the other hand. This equilibrium results as long as the recording medium 120 has sufficient fluid that can evaporate. Consequently, an essentially constant equilibrium temperature 213 arises.

If the recording medium 120 no longer has any fluid that can evaporate, the latent heat does not apply, and the thermal energy applied to the recording medium 120 within the drying system 150 leads to a warming of the recording medium 120, and thus to an increase in the temperature of the recording medium 120.

If a relatively small fluid quantity that is less than the fluid quantity limit 311 is located on the recording medium 120 at the input of the drying system 150, this leads to the situation that latent heat is no longer generated as of a defined position along the drying route of the drying system 150, and thus the temperature of the recording medium 120 increases on the remaining drying route. The position along the drying route as of which latent heat is no longer generated, and as of which fluid thus no longer evaporates from the recording medium 120, may be concluded from the temperature value of the temperature of the recording medium 120 at the end of the drying route.

FIG. 3*b* shows different temperature/fluid quantity correlations 321, 322, 323 for different drying capacities of the drying system 150. In other words, the drying system 150 may be operated with different drying capacities, wherein the drying capacity is an example of drying parameters of the drying system 150. The correlation 321 thereby results given a relatively low drying capacity, the correlation 322 given an average drying capacity, and the correlation 323 given a relatively high drying capacity.

From FIG. 3*b*, it is clear that an essentially constant equilibrium temperature 213 appears, independently of the drying capacity that is used, as long as the recording medium 120 has a sufficient fluid quantity that may evaporate. From FIG. 3*b*, it is thus to be learned that the equilibrium temperature 213 is independent of the drying capacity.

As soon as fluid is no longer located on the recording medium 120, the temperature of the recording medium 120 increases. Due to the fact that the quantity of fluid that may evaporate within the drying system 150 increases with increasing drying capacity, the fluid quantity limit 311 increases with increasing drying capacity.

The effect described in conjunction with FIGS. 3*a* and 3*b* may be used to determine and/or adapt the degree of drying of a recording medium 120 that is produced in a drying system 150 and/or along a drying route. FIG. 2*a* shows an example of a drying system 150 or drying route having one or more temperature sensors 200. The drying system 150 depicted in FIG. 2*a* comprises a plurality of temperature sensors 200 that are arranged at different positions along the drying route. The curve of the temperature of the recording medium 120 along the drying route may be detected using the one or more temperature sensors 200.

An example of a temperature curve 210 is depicted in FIG. 2*b*. The temperature curve 210 thereby indicates the temperature of the recording medium 120 as a function of the position along the drying route. The position along the drying route thereby corresponds to a point in time within the drying process. The recording medium 120 exhibits the equilibrium temperature 213 up to a defined slope position 211 along the drying route, meaning up to a defined rise point in time. This is due to the fact that the recording medium 120 has sufficient fluid from the print image up to the slope position 211, such that an equilibrium of latent heat and the thermal energy supplied within the scope of the drying results.

As of the slope position 211, the temperature of the recording medium 120 increases since an evaporation of fluid no longer occurs, or at least no significant evaporation of fluid. The thermal energy supplied within the scope of the drying therefore leads to an increase in the temperature up to the end position 212 of the drying route. The location of the slope position 211 along the drying route, and/or the temperature value or measurement value 214 of the temperature of the recording medium 120 at the end 212 of the drying route, may be used as an indicator of the degree of drying of the recording medium 120.

A processing and/or processor/controller 151 of the drying system 150 may be configured to determine the slope position 211 and/or the temperature value 214 of the temperature of the recording medium 120 at the end 212 of the drying route on the basis of the sensor data of the one or more temperature sensors 200 of the drying system 150, meaning on the basis of the temperature or measurement values 215. The degree of drying of the recording medium 120 may then be determined on the basis of the determined slope position 211 and/or on the basis of the determined temperature value 214 of the temperature of the recording medium 120 at the end 212 of the drying route. Alternatively or additionally, a drying parameter of the drying system 150 may be set and/or adapted depending on the determined slope position 211 and/or depending on the determined temperature value 214 of the temperature of the recording medium 120 at the end 212 of the drying route, for example in order to set, in particular to regulate, the slope position 211 and/or the temperature value 214 to a nominal value. The quality of the drying of the recording medium 120 may thus be increased. In an exemplary embodiment, the controller 151 includes processor circuitry that is configured to perform one or more functions and/or operations of the controller 151.

In an aspect of the disclosure, a method is described with which the degree of drying, thus the residual moisture on the recording medium 120, may be determined after application of fluid onto a recording medium 120 and due to the evaporation at defined points in time.

Furthermore, it may be detected when the fluid on the recording medium 120 has completely evaporated. The effect is thereby utilized that, due to the introduction of thermal energy, an equilibrium of the introduced thermal energy and the latent heat appears upon evaporation. The equilibrium temperature or cooling temperature limit 213 that thereby results is maintained until the fluid on the recording medium 120 has completely evaporated, and the recording medium 120 may thereupon warm without being cooled off due to latent heat. A change, in particular a sharp bend, in the temperature curve 210 thus results when the fluid has completely evaporated. It may then be concluded that the evaporation has concluded. Alternatively or additionally, the degree of drying of the recording medium 120 may be concluded via evaluation of the temperature curve 210.

A defined quantity of fluid may be applied onto the recording medium 120 to measure the correlations 310, 321, 322, 323 depicted in FIGS. 3*a* and 3*b*. Different amounts of fluid may thereby be applied successively in different regions of the recording medium 120. It is thereby not necessary to know the absolute quantity of applied fluid; rather, it may be sufficient that the variation of the applied fluid quantities with respect to one another is known.

The recording medium 120 may then be moved by a drying system 150 and/or along a drying route. The temperature of the recording medium 120 may then be measured at least at one point along the drying route or at the end of the drying route. For example, a contact-less infrared temperature 200 may be used for this purpose. Which of the applied fluid quantities in the different regions has evaporated, and in which of one or more regions residual moisture is still present on the recording medium 120 because the applied fluid quantity was too great, may be determined on the basis of the temperature. Information about the fluid quantity that has evaporated at different points in time or positions along the drying route may be determined via this procedure. Information about the degree of drying of a recording medium 120 may thus be determined.

From FIG. 3*a*, it is to be learned that the regions of the recording medium 120 at which a fluid quantity that is less than the limit quantity 311 have dried completely, since in these regions the temperature is increased in comparison to regions with greater fluid quantities. The drying process is thus concluded in these regions at the point in time of the temperature measurement. The less fluid that has been applied, the higher the temperature. This is to be explained in that the smaller fluid quantities have evaporated faster, and thus the time period of the latent heat was shorter, and as a result of this the warming of the recording medium 120 started earlier.

The regions with fluid quantities that are greater than the limit quantities 311 have not yet completely dried at the point in time of the temperature measurement since these regions all exhibit the same temperature, namely the equilibrium temperature 213. This is to be explained in that fluid for evaporation is still present on the recording medium 120, and thus latent heat continues to ensure an equilibrium between warming and cooling. Which regions with which fluid quantities still exhibit residual moisture at the point in time of measurement, and which have dried completely, may thus be determined.

FIG. 3*b* shows examples of measurement results for different drying capacities. It is thereby apparent that, given a relatively low warming capacity (represented by the correlation 321, for example), regions with relatively low fluid quantities have not yet dried completely since the temperature in these regions has not yet risen above the equilibrium temperature 213. By contrast, given a relatively high warming capacity (represented by the correlation 323, for example), all dampened regions up to relatively high fluid quantities have dried completely, since increased temperatures are measured in all regions or for all fluid quantities.

Information regarding the curve of the drying may be determined by measuring the temperature at various points in time and/or positions within the process curve or along the drying route. In particular, at which point in time which fluid quantities have evaporated may be determined.

A determined temperature value 215 may be compared with a temperature threshold, wherein the temperature threshold depends on the equilibrium temperature 213. For example, the threshold may be at a defined measurement tolerance, for example 10%, above the equilibrium temperature 213. Whether the measured region of a recording medium 120 has completely dried or not may be decided via the threshold comparison.

FIG. 4 shows a workflow diagram of an example of a method 400 for drying a substrate 120, in particular a recording medium. The method 400 may be executed in a drying system 150, in particular in a drying system 150 of a printing device 100.

The method 400 first includes the application 405 of a defined fluid quantity onto the recording medium, and then the supplying 401 of thermal energy to the substrate 120 in order to dry said substrate 120 via evaporation of fluid. The fluid may thereby be based on a print image printed onto the substrate 120. In particular, the fluid may have been caused by ink that has been applied onto the substrate 120. The drying of the substrate 120 may be intended to dry and fix the print image on the substrate 120. The thermal energy may be supplied to the substrate 120 via convection, radiation, and/or conduction or thermal conduction.

The method 400 also includes the detection 402 of a temperature value 215 of the temperature of the substrate 120 during the drying and/or along the drying route. The one or more temperature values 215 may indicate the temperature of the substrate 120 at one or more points in time during the drying and/or at one or more positions along the drying route. The one or more temperature values 215 may be detected by means of a temperature sensor 200, for example, in particular by means of an infrared (IR) sensor.

Furthermore, the method 400 includes the comparison 403 of the at least one temperature value 215 with a temperature threshold. The temperature threshold may thereby depend on the equilibrium temperature 213 of the substrate 120, which results given an equilibrium of latent heat and supplied thermal energy. The temperature threshold may, for example, be a defined tolerance value, for example between 5% and 15% above the equilibrium temperature 213. If the temperature value 215 is above the temperature threshold, this may be an indicator that the equilibrium of latent heat and supplied thermal energy is no longer present, and that the quantity of evaporated fluid has decreased. This is in turn an indicator of a relatively high degree of drying of the substrate 120. On the other hand, a temperature value 215 below the temperature threshold is an indicator that a relatively large quantity of fluid is still evaporating, and thus that a relatively low degree of drying of the substrate 120 is present.

The degree of drying of the substrate 120 may be 100%, for example, if the entirety of the fluid applied onto the substrate 120 has evaporated, in particular the entire fluid fraction in the applied ink. On the other hand, the degree of drying of the substrate 120 may be 0% if the applied fluid has not yet evaporated at all. A linear subdivision of the entire applied fluid quantity may take place between 0% and 100%.

The method 400 may also include the determination 404 of information with regard to the degree of drying of the substrate 120 depending on the comparison. Alternatively or additionally, the method 400 may include the adaptation 404 of the supplied thermal energy depending on the comparison, for example in order to adjust the degree of drying of the substrate 120 to a defined nominal value.

A drying system 150 for drying a substrate 120, in particular a recording medium, is thus described in this document. The drying system 150 may be used in a printing device 100, in particular in an inkjet printing device, in order to dry and/or fix a print image printed onto the substrate 120.

The drying system 150 comprises at least one dryer 160, 170, 180 that is configured to supply thermal energy to the substrate 120 in order to dry said substrate 120 via evaporation of fluid. Examples of dryers 160, 170, 180 are a convection dryer 160, a thermal conductivity or conduction dryer 170, and a radiant dryer 180. The drying system 150 may comprise a plurality of dryers 160, 170, 180 that are arranged along a drying route. Furthermore, the drying system 150 may be configured to guide or move the substrate 120 along the drying route for drying.

The drying system 150 also comprises at least one temperature sensor 200, in particular a contact-less temperature sensor, that is configured to detect at least one temperature value 215 of the temperature of the substrate 120. The temperature value 215 may be detected at a defined point in time during the drying and/or at a defined position of the drying route. The one or more temperature sensors 200 of the drying system 150 may be arranged at different positions along the drying route, for example. In particular, the one or more temperature sensors 200 may be configured to detect a temperature curve 210 with a sequence of temperature values 215 for a corresponding sequence of points in time, or for a corresponding sequence of positions along the drying route. In an exemplary embodiment, the temperature sensor 200 includes processor circuitry that is configured to perform one or more functions and/or operations of the temperature sensor 200.

Furthermore, the drying system 150 comprises a processor 151 that may be configured to compare the temperature value 215 with a temperature threshold. The temperature threshold may thereby depend on the equilibrium temperature 213 that results at the substrate 120 given an equilibrium of latent heat and supplied thermal energy. For example, the temperature threshold may be a defined percentage higher than the equilibrium temperature 213, for example 5%-15%, in particular in order to taken into account measurement tolerances of the temperature measurement. The equilibrium temperature 213 may depend on the type of recording medium 120. The equilibrium temperature 213 may be determined experimentally in advance.

Depending on the comparison, information with regard to the degree of drying of the substrate 120 may then be determined. If applicable, it may be determined that the substrate 120 has not yet dried completely, and thus has a degree of drying of less than 100%, if it is determined that the temperature value 215 is less than the temperature threshold. Alternatively or additionally, it may be determined that the substrate 120 has dried completely, and if applicable has a degree of drying of 100%, if it is determined that the temperature value 215 is greater than the temperature threshold. Information with regard to the degree of drying may be determined efficiently and precisely via the comparison of the measured temperature with the temperature threshold depending on the equilibrium temperature 213.

Alternatively or additionally, the processor 151 may be configured to operate the at least one dryer 160, 170, 180 depending on the comparison. In particular, a drying parameter of the dryer 160, 170, 180 may thereby be adapted depending on the comparison of the temperature value 215 with the temperature threshold. Examples of drying parameters are: the thermal capacity for drying the substrate; and/or the manner of how thermal energy is supplied to the substrate 120, in particular via conduction or thermal conductivity, via convection, or via radiation; and/or the temperature of the drying medium 164; and/or the temperature of the heating saddle; and/or the intensity and/or the frequency of the radiation 184.

The processor 151 may in particular be configured to operate the at least one dryer 160, 170, 180 depending on the comparison of the temperature value 215 with the temperature threshold in order to set the temperature value 215 to a nominal value, in particular to the temperature threshold, and/or in order to adjust the slope position 211 or the slope point in time of the of the temperature curve 210 to a defined nominal value. The degree of drying of a substrate 120 may be adjusted efficiently and precisely via the comparison of the measured temperature with the temperature threshold depending on the equilibrium temperature.

A drying system 150 having at least one dryer 160, 170, 180 is thus described that is configured to supply thermal energy to a substrate 120 in order to dry said substrate 120 via evaporation of fluid. Information with regard to the degree of drying of the substrate 120 may be precisely determined via comparison of a measurement value 215 of the temperature of the substrate 120 with the equilibrium temperature 213, which results upon equilibrium of latent heat and supplied thermal energy. Alternatively or additionally, the degree of drying of the substrate 120 may be precisely adjusted.

As has already been presented above, the at least one temperature sensor 200 may be configured to detect the temperature curve 210 of the temperature of the substrate 120 during the drying within the drying system 150. The temperature curve 210 may thereby indicate the temperature of the substrate 120 as a function of time within the duration of the drying process, or as a function of the position along the drying route of the drying system 150.

The processor 151 may be configured to determine, via comparison of the temperature curve 210 with the temperature threshold, a slope point in time and/or a slope position 211 along the drying route at which the temperature of the substrate 120 reaches or exceeds the temperature threshold. The slope point in time and/or the slope position 211 may thereby indicate the moment during the drying as of which the equilibrium of latent heat and supplied thermal energy breaks due to the reduction or due to the cessation of the latent heat, and thus leads to a rise of the temperature of the substrate 120. The slope point in time and/or the slope position 211 may be detected on the basis of the comparison with the temperature threshold, in particular as the point in time or as the position as of which the temperature of the substrate 120, meaning the temperature value 215, reaches or exceeds the temperature threshold.

The information with regard to the degree of drying of the substrate 120 may then be determined especially precisely on the basis of the determined slope point in time and/or on the basis of the determined slope position 211. Alternatively or additionally, the dryer 160, 170, 180 may be operated especially precisely depending on the determined slope point in time and/or depending on the determined slope position 211. In particular, at least one drying parameter may be adapted in order to set the slope point in time to a defined nominal point in time, and/or in order to set the slope position 211 to a defined nominal position. The degree of drying of a substrate may thus be precisely set.

The processor 151 may be configured to compare the measured temperature curve 210 with a reference curve. For example, the value of a clearance, for example the quadratic mean deviation, between the measured temperature curve 210 and the reference curve may thereby be determined. Alternatively or additionally, the cumulative deviation of the measured temperature curve 210 from the reference curve may be determined, for example as the area between the measured temperature curve 210 and the reference curve.

The reference curve may, for example, indicate a reference or nominal temperature of the substrate 120 as a function of time or as a function of position along the drying route of the drying system 150. The reference curve of the temperature of the substrate 120 may be associated with a curve of the degree of drying of the substrate 120 during the drying process, in particular such that the reference curve indicates the degree of drying of the substrate 120 during the drying in the event that the actual temperature curve 210 corresponds to the reference curve. Typically, the degree of deviation of the actual degree of drying from the degree of drying indicated by the reference curve increases with an increasing degree of deviation of the measured temperature curve 210 from the reference curve. On the other hand, given a relatively small deviation of the measured temperature curve 210 from the reference curve, the degree of drying of the substrate 120 during the drying may be precisely concluded. The degree of deviation may likewise be used in order to determine the degree of drying of the substrate 120.

The processor 151 may thus be configured to determine the information with regard to the degree of drying of the substrate 120 on the basis of the comparison of the measured temperature curve 210 with the reference curve. Alternatively or additionally, the processor 151 may be configured to operate the dryer 160, 170, 180 depending on the comparison of the measured temperature curve 210 with the reference curve. The degree of drying of the substrate 120 may thus be determined and/or set especially precisely.

The processor 151 may be configured to compare the temperature value 215 and/or the measured temperature curve 210 with characteristic data. The characteristic data may thereby indicate a correlation between the temperature of the substrate 120 and the degree of drying of the substrate 120. In particular, the characteristic data may, if applicable, also indicate a degree of drying in the event that the substrate 120 exhibits the equilibrium temperature 213 and/or the temperature threshold as a temperature. The characteristic data may have been determined in advance, possibly experimentally. The degree of drying of the substrate 120 may then be determined especially precisely, and/or the dryer 160, 170, 180 may be operated especially precisely, based on the comparison of the temperature curve 210 with the characteristic data.

The processor 151 may be configured to determine quantity information with regard to a fluid quantity, in particular with regard to an ink quantity, which has been applied onto the substrate 120. The fluid quantity may, for example, be determined on the basis of the print data with regard to the print image that has been printed onto the substrate 120.

The quantity information may be taken into account in the evaluation of the temperature value 215 and/or in the evaluation of the temperature curve 210. For example, the reference curve and/or the characteristic data may be adapted depending on the quantity information. Alternatively or additionally, the point in time after beginning the drying of the substrate 120 at which the temperature value 215 is detected, and/or the position along the drying route for drying the substrate 120 at which the temperature value 215 is detected, may be established depending on the quantity information. The degree of drying of the substrate 120 may thus be determined or set especially precisely.

Furthermore, in this document a printing device 100 is described, in particular an inkjet printing device, that comprises the drying system 150 described in this document.

Via the measurement method described in this document, the degree of drying of a recording medium 120 may be detected precisely without retroactive effect on the actual drying process. Based on this, the drying process may be specifically acted upon in order to monitor the drying process. The temperature measurement used to determine the degree of drying may take place cost-effectively and efficiently in terms of installation space, for example by means of an IR sensor. The described method 400 may thus be efficiently integrated into a drying system 150. The described method 400 has a good reproducibility and is typically independent of the type of recording medium 120 that is used. The described method 400 may thereby be applied to recording media 120 in the form of a web or page or sheet. Furthermore, the described method 400 may be used in conjunction with different drying methods and/or with different types of printing devices 100. The described measurement methods may also be used in other processes and apparatuses in which a known fluid quantity is applied onto a substrate 120 and dried.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
21, 22 nozzle
31, 32 column (of the print image)
100 printing device
101 controller
102 print bar
103 print head
120 recording medium/substrate
140 print group
150 fixing or drying system
151 processor/controller (for drying system)
160 convection dryer
161 controller
162 heating element
163 nozzle
164 tempered drying medium (fluid, in particular air)
165 blower
166 temperature sensor
170 thermal conductivity dryer
180 radiant dryer
181 controller
183 radiation source
184 radiation
186 temperature sensor
200 temperature sensor
210 temperature curve
211 slope position
212 end position
213 equilibrium temperature
214 temperature value at the end of the drying
215 temperature value or measurement value
310 temperature/fluid quantity correlation
311 limit value
321, 322, 323 temperature/fluid quantity correlation
400 method for drying a substrate
401-404 method steps

The invention claimed is:

1. A drying system for drying a substrate, the drying system comprising:

at least one dryer that is configured to supply thermal energy to the substrate to dry the substrate via an evaporation of fluid;

at least one temperature sensor that is configured to detect at least one temperature value of a temperature of the substrate; and a processor that is configured to:

compare the temperature value with a temperature threshold that depends on an equilibrium temperature, wherein the equilibrium temperature is a temperature where an equilibrium of latent heat and supplied thermal energy; and determine information corresponding to a degree of drying of the substrate based on the comparison, and/or operate the dryer based on the comparison.

2. The drying system according to claim 1, wherein:

the temperature sensor is configured to detect a temperature curve of the temperature of the substrate during the drying within the dryer, the temperature curve indicating the temperature of the substrate as a function of time, or as a function of position along a drying route of the dryer; and the processor is configured to:

determine, via comparison of the temperature curve with the temperature threshold, a slope point in time and/or a slope position along the drying route at which the temperature of the substrate reaches or exceeds the temperature threshold; and determine the information corresponding to the degree of drying of the substrate based on the determined slope point in time and/or based on the determined slope position, and/or operate the dryer based on: the determined slope point in time and/or the determined slope position.

3. The drying system according to claim 1, wherein:

the temperature sensor is configured to detect a temperature curve of the temperature of the substrate during the drying within the dryer; wherein the temperature curve indicates the temperature of the substrate as a function of time or as a function of position along a drying route of the dryer; and the processor is configured to:

compare the measured temperature curve with a reference curve indicative of a reference temperature or nominal temperature of the substrate as a function of time or as a function of position along a drying route of the dryer; and determine the information corresponding to the degree of drying of the substrate based on the comparison, and/or operate the dryer based on the comparison.

4. The drying system according to claim 1, wherein the processor is configured to:

compare the temperature value with characteristic data indicative of a correlation between the temperature of the substrate and indicative of a degree of drying for the equilibrium temperature and/or for the temperature threshold; and determine the degree of drying of the substrate based on the comparison, and/or to operate the dryer based on the comparison.

5. The drying system according to claim 1, wherein the processor is configured to:

determine that the substrate has not yet entirely dried in response to a determination that the temperature value is less than the temperature threshold; or determine that the substrate has dried completely in response to a determination that the temperature value is greater than the temperature threshold.

6. The drying system according to claim 1, wherein the processor is configured to:

determine that the substrate has not yet entirely dried in response to a determination that the temperature value is less than the temperature threshold; and determine that the substrate has dried completely in response to a determination that the temperature value is greater than the temperature threshold.

7. The drying system according to claim 1, wherein:

the processor is configured to adapt a drying parameter of the dryer based on the comparison of the temperature value with the temperature threshold; and the drying parameter includes:

a thermal capacity for drying the substrate; and a manner in which thermal energy is supplied to the substrate.

8. The drying system according to claim 7, wherein the manner in which thermal energy is supplied to the substrate includes conduction, convection, or radiation.

9. The drying system according to claim 1, wherein the processor is configured to operate the dryer based on the comparison to set the temperature value to a nominal value.

10. The drying system according to claim 9, wherein the nominal value is the temperature threshold.

11. The drying system according to claim 1, wherein the processor is configured to:

determine quantity information corresponding to a fluid quantity that has been applied onto the substrate; and (a) determine the information corresponding to the degree of drying of the substrate based on the quantity information and/or operate the dryer based on the quantity information; and/or (b) establish, based on the quantity information, a point in time at which the temperature value is determined after the beginning of the drying of the substrate, and/or a position along a drying route for drying the substrate at which the temperature value is detected.

12. The drying system according to claim 1, wherein:

the drying system comprises a plurality of dryers that are arranged along a drying route;

the drying system is configured to guide the substrate along the drying route for drying; and the temperature sensor is configured to detect the temperature value at least at one position along the drying route.

13. The drying system according to claim 1, wherein the drying system is comprised within a printer and the substrate is a printed recording medium.

14. A method for drying a substrate, comprising:

supplying thermal energy to the substrate to dry the substrate via evaporation of fluid;

detecting at least one temperature value of a temperature of the substrate during or after the drying;

comparing the temperature value with a temperature threshold that depends on an equilibrium temperature of the substrate, wherein the equilibrium temperature is a temperature where an equilibrium of latent heat and supplied thermal energy; and determining information corresponding to a degree of drying of the substrate based on the comparison, and/or adapting the supply of thermal energy based on the comparison.

15. A non-transitory computer-readable storage medium with an executable program stored thereon, wherein, when executed, the program instructs a processor to perform the method of claim 14.

* * * * *